US010745969B1

(12) United States Patent
Robertson

(10) Patent No.: US 10,745,969 B1
(45) Date of Patent: Aug. 18, 2020

(54) STORAGE DEVICE FOR STORING WORK-TOOLS AND HANGABLE TO AND REMOVABLE FROM A LADDER

(71) Applicant: James V. Robertson, Elmira, NY (US)

(72) Inventor: James V. Robertson, Elmira, NY (US)

( * ) Notice: Subject to any disclaimer, the term of this patent is extended or adjusted under 35 U.S.C. 154(b) by 0 days.

(21) Appl. No.: 16/026,812

(22) Filed: Jul. 3, 2018

(51) Int. Cl.
*E06C 7/14* (2006.01)
*E06C 7/16* (2006.01)
*B25H 3/06* (2006.01)

(52) U.S. Cl.
CPC ..... *E06C 7/14* (2013.01); *B25H 3/06* (2013.01); *E06C 7/16* (2013.01)

(58) Field of Classification Search
CPC ..... E06C 7/14; E06C 7/16; E06C 7/00; B25H 3/00; B25H 3/06
USPC ..... 182/129, 121; 248/210, 211, 238, 311.2, 248/317, 339, 340; 208/373–375; 211/71.01
See application file for complete search history.

(56) References Cited

U.S. PATENT DOCUMENTS 3,757,380 A * 9/1973 Jackson ..... B44D 3/14 15/257.05
4,480,810 A * 11/1984 Hall ..... E06C 7/14 182/129
5,079,795 A * 1/1992 Schmid ..... B44D 3/126 15/257.06
7,077,238 B2 7/2006 Butler et al.
8,016,075 B2 * 9/2011 Pohl ..... E06C 7/14 15/257.06
8,448,959 B1 * 5/2013 Pohot ..... B25H 3/02 280/47.131
10,213,915 B1 * 2/2019 DeMarco ..... B25H 3/04
2009/0020446 A1 * 1/2009 Frankenstein ..... B25H 3/04 206/373

* cited by examiner

*Primary Examiner* — Tan Le
(74) *Attorney, Agent, or Firm* — Sanchelima & Associates, P.A.; Christian Sanchelima; Jesus Sanchelima

(57) ABSTRACT

The present invention discloses a storage device that is easily hanged to and removed from any rungs of a ladder such that the storage device is positioned at any desired height of ladder thereby facilitating working at ergonomic height. Storage device includes a mounting plate, one or more hanging members and at least one of one or more storage boxes and one or more tool holders. Mounting plate mounts hanging members, storage boxes and/or tool holders. Hanging members are hook-shaped that can receive rungs of ladder and sit thereon for facilitating easy hanging of storage device on ladder. Storage boxes and tool holders facilitate holding of various work-tools. User can then position storage device on any portion of ladder so that work-tools are available at ergonomic height. After use, user can easily lift storage box and remove from storage box from ladder, thereby facilitates easy removal.

14 Claims, 4 Drawing Sheets

STORAGE DEVICE FOR STORING WORK-TOOLS AND HANGABLE TO AND REMOVABLE FROM A LADDER

BACKGROUND OF THE INVENTION

1. Field of the Invention

The present disclosure relates to a device for holding work-tools. More particularly, the present disclosure relates to a storage device that is hanged to and removed from a ladder for facilitating hands-free working.

2. Description of the Related Art

Many a time, a workman while working on at an elevated height by standing on a ladder needs to hold one or more work-tool(s) in one hand and perform work by other which causes inconvenience and also does not allow user to grip. A portable storage device is alternatively used by user to hold work-tools storage device is positioned on one or more rung/rail of ladder by the user. However, storage tool are likely to fall and cause accidents if fallen from a height. Hence, there is a need for a storage device.

Several designs of various storage devices have been designed in the past. None of them, however, include a multipurpose storage device for storing work-tools that is easily hanged to and removed from a ladder and easy to port from one place to another.

Applicant believes that a related reference corresponds to U.S. Pat. No. 7,077,238 filed by Butler et al. for a ladder caddy. The Butler reference discloses a ladder caddy having a mounting arrangement that enables the ladder caddy to mount on the rungs of the ladder in a first position and a second position (inverted first position). However, the ladder caddy disclosed by Butler may cause hindrance to a workman while climbing up or getting down as the construction and mounting arrangement of the ladder caddy is complex and occupies most of the space along a width of the ladder.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention is to provide a storage device that is effortlessly hanged to and removed from rungs of a ladder for holding work-tools.

It is another object of the present invention is to provide a storage device that is easily hanged to and removed from any rungs of a ladder such that the storage device is positioned at any desired height of ladder thereby facilitating working at ergonomic height.

It is still another object of the present invention is to provide a storage device that is easily portable.

It is yet another object of the present invention is to provide a storage device which is hanged to a ladder and positioned on the ground to avoid displacement of work-tools when not in use.

It is still another object of the present invention is to provide a storage device having one or more hanging member(s) for hanging and removing the storage device on a ladder.

It is still another object of the present invention is to provide a storage device having one or more storage boxes for storing small sized work-tools.

It is still another object of the present invention is to provide a storage device having one or more tool holder with openings that receives and holds work-tools.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
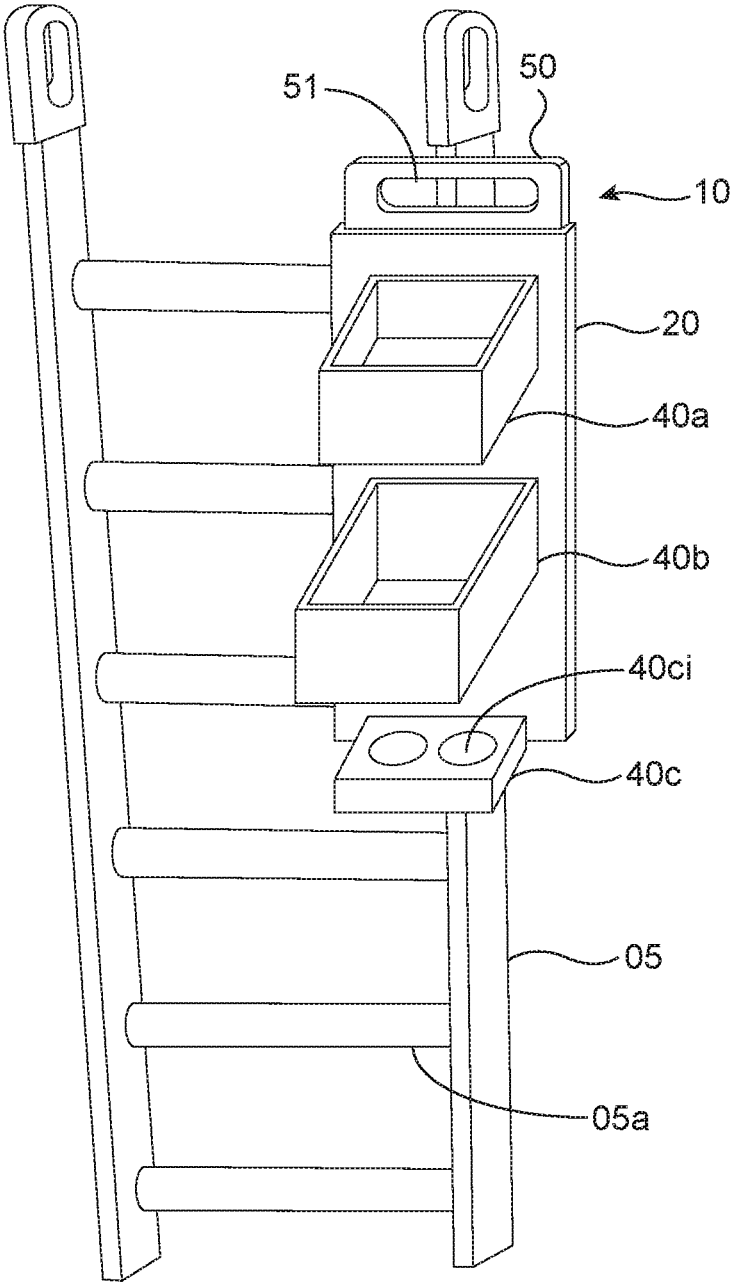
FIG. 1 is a perspective view showing a ladder 05 positioned upright and a storage device 10 hanged proximal to a top end of ladder 05, in accordance with an embodiment of the present invention.
Figure 2:
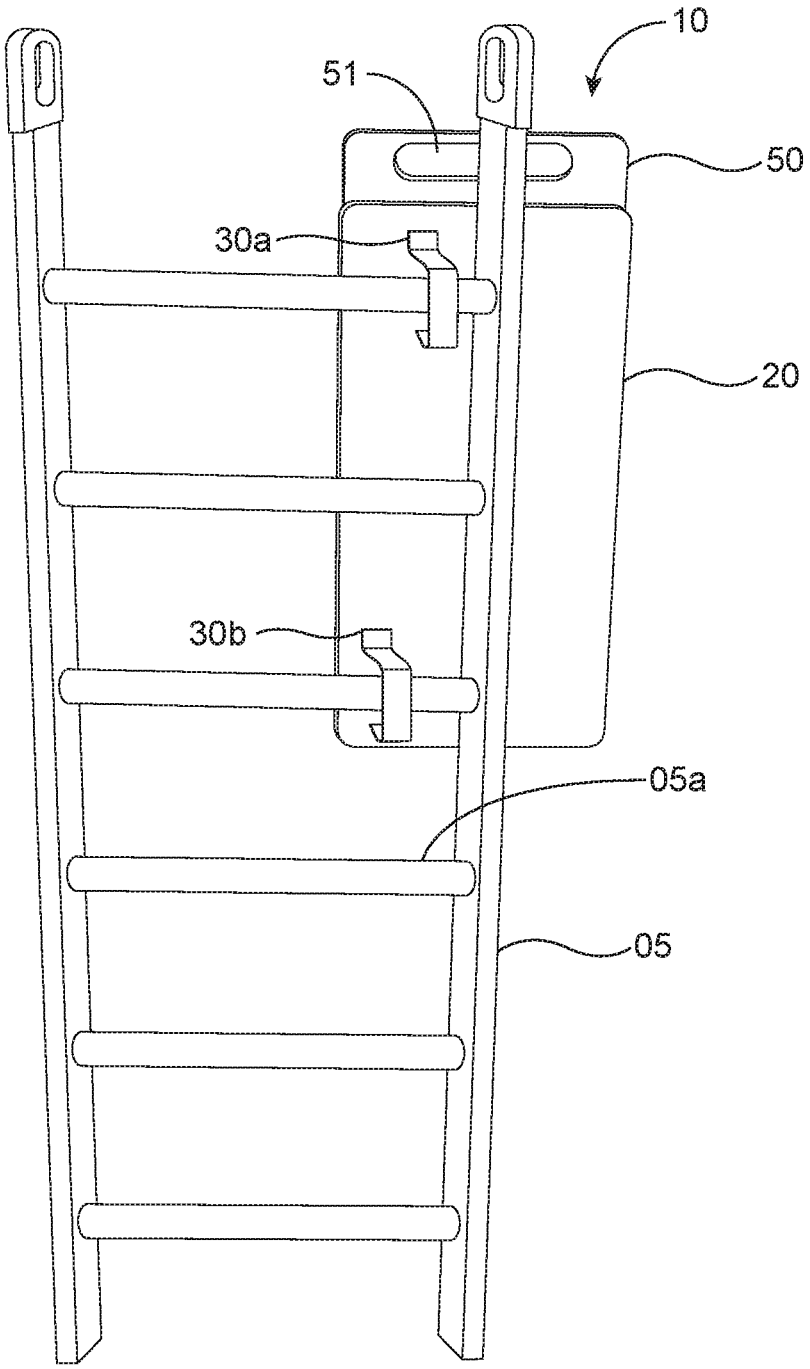
FIG. 2 is a perspective view showing two hanging members 30*a* and 30*b* for hanging the storage device on rungs 05*a* of the ladder 05.
Figure 3:
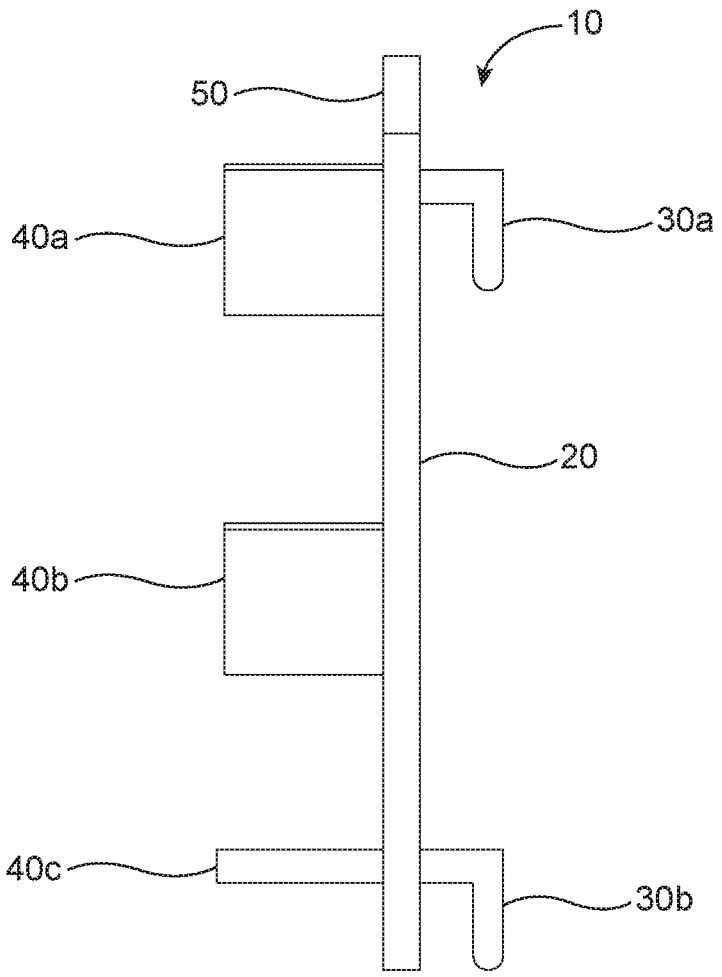
FIG. 3 is a side view of the storage device 10 depicting storage boxes 40*a* and 40*b*, tool holder 40*c* and two hanging members 30*a* and 30*b*.

Referring now to drawings, FIGS. 1-3, where the present invention is generally referred with numeral 10, it can be observed that a storage device which is hanged to and removed from rungs 05*a* of a ladder 05, in accordance with one embodiment is provided that includes a mounting plate 20, one or more hanging members 30*a* and 30*b* and at least one of storage boxes 40*a* and 40*b* and tool holder 40*c*. In depicted embodiment, the storage device 10 is attached proximal to a top end of the ladder 05, as shown in FIGS. 1-2. However, the storage device 10 can be attached to any convenient position along a length of the ladder 05 defined between the top end and a bottom end thereof such that user can ergonomically pick work-tool(s).

Mounting plate 20 is defined with a rear face which mounts two hanging members 30*a* and 30*b* and a front face which mounts storage boxes 40*a* and 40*b* and tool holder 40*c*. Mounting plate 20 can be made from any material or combination of materials like polymeric, wood or metal. Shape of the mounting plate 20 can be rectangular, square or any other type of shapes or combination of shapes. Size i.e. the thickness, the length and the width of the mounting plate 20 may be selected based on the desired load carrying capacity. Mounting plate 20 is further defined with at least one handle 50 having an aperture 51 to enable a user to easily carry and move the storage device 10 from one place to another. In depicted embodiment, mounting plate 20 is provided at the top edge of the mounting plate 20, however, handle(s) 50 can be provided along either side portions of mounting plate 20. In the illustrated embodiment, the handle 50 is integral with mounting plate 20 and aperture 51 is provided to hold storage device 10 by inserting user's hand. In an alternate embodiment, the handle 50 can be an individual component detachably coupled to mounting plate 20 or foldable for ease of carrying from one place to another.

Hanging members 30*a* and 30*b* is coupled, fixedly or removable, on rear face of mounting plate 20 and proximal to the top edge and the bottom edge respectively. Hanging members 30*a* and 30*b* are hook-shaped having a curved or indent which receives rungs 05*a* of ladder 05 for hanging the hanging members 30*a* and 30*b* on ladder 05. Number of hanging members 30*a* and 30*b* can be varied based on the size of mounting plate 20 and amount of weight to be lifted by storage device 10. Hanging members 30*a* and 30*b* in one form can be fixed or in another form can be adjustable to be fitted on different types of ladders with variable distances between the adjacently disposed rungs. Though hanging members 30*a* and 30*b* are illustrated by one on top edge and another on bottom edge of mounting plate 20, however, two or more hanging members 30*a* and 30*b* can be provided horizontally adjacent to each other. Also, hanging members 30*a* and 30*b* can be provided at substantially central portion or portion in-between the top edge and the bottom edge of mounting plate 20.

Storage boxes 40*a* and 40*b* are hollow boxes with open top for receiving work-tools like nuts, bolts, rawl/push plug, bolts or washers and are adapted to store or hold various work-tools like nuts, bolts, rawl/push plug, bolts or washers. Storage boxes 40*a* and 40*b* are positioned on mounting plate 20 and at desired position. Storage boxes 40*a* and 40*b* can be one in number or more. Storage boxes 40*a* and 40*b* can be fixedly connected or detachably connected to mounting plate 20. Size of the storage boxes 40*a* and 40*b* can be modified or adjustable based on the requirement. Storage boxes can be of same size or of different sizes. Storage boxes 40*a* and 40*b* can be of any shape like square, rectangular, circular or any other shapes or combination of shapes.

Tool holder 40*c* can be provided on any portion of mounting plate 20. Tool holder 40*c* includes one or more openings 40*ci* for work-tools, like hand drill or screw gun and the like, that is/are inserted in and supported by openings 40*ci*. Although, openings 40*ci* illustrated are circular shaped, however, openings 40*ci* can be of any shape such as square, rectangle, oval, and polygon and can be of variable sizes.

Figure 4:
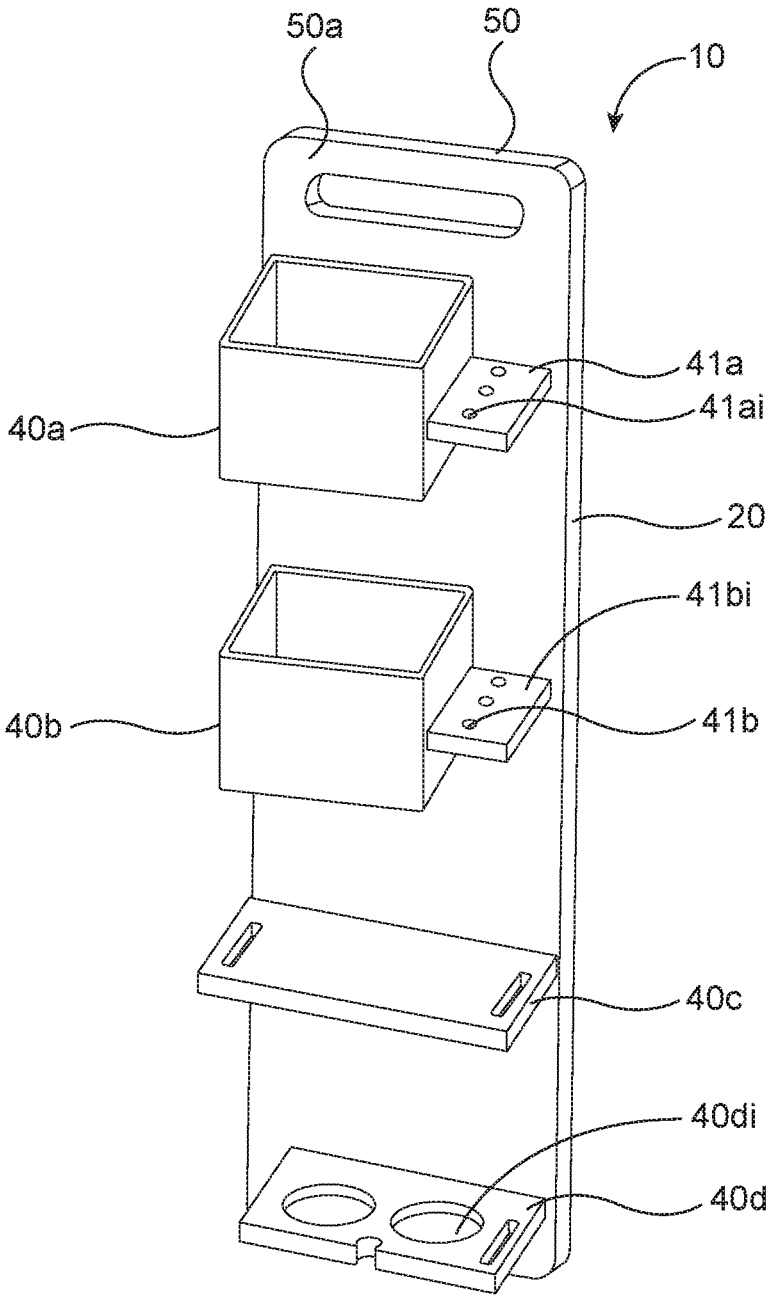
FIG. 4 is a perspective view of a storage device 10 hanged to the ladder 05, in accordance with another embodiment of the present invention.

Referring to FIG. 4, a perspective view of a storage device 10 is illustrated, in accordance with another embodiment of the present invention. The storage device 10 includes a mounting plate 20, two hanging members (not illustrated in Figure), storage boxes 40*a* and 40*b*, first tool holders 41*a* and 41*b* having openings 41*ai* and 41*bi* respectively provided, planar element 40*c* and second tool holders 40*d* having opening 40*di*. First tool holders 40*a* with openings 41*ai* and 40*b* with openings 40*bii* are adjacently positioned to storage boxes 40*a* and 40*b* and in one form can be integral with each other or separate from each other. Planar element 41 can be optionally provided to place anything desired.

Thus, a storage device, of the present disclosure, can be formed of any combination or variations of one or more of storage box(es), tool holder(s) and/or planar element(s) and provided with hanging members for easy hanging and removing of storage device from one or more rung of a ladder. Storage device 10 in one form is hanged to ladder 05 and is supported on the ground to avoid displacement of work-tools when not in use. Storage device 10 can be positioned at any desired ergonomic height on ladder 05. In one embodiment, storage box 10 can be swiveled so as to suite different applications like left side application or right side application.

In operation, initially, ladder 05 is positioned upright. Storage device 10 is lifted by handle 50 by inserting user's hand in aperture 51 and user can climb up the ladder 05. Two hanging members 30*a* and 30*b* are inserted and hanged on rungs 05*a* of the ladder 05. Once inserted, handle 50 is released and storage device 10 hangs on rungs 05*a*. Work-tools can be positioned before placing storage device 10 on ladder 05 or after placing storage device 10 on ladder 05. Storage device 10 thus eliminates the need for to hold work-tools in hand and hence enable user to grip the ladder.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A storage device for storing work-tools, said storage device comprising:

a. a mounting plate defined with a front portion and a rear portion, said rear portion further defined by an upper portion and a lower portion, said mounting plate having a width;

b. at least one handle disposed on said mounting plate on a top end of said mounting plate, said at least one handle having a handle width, said width of said mounting plate being greater than said handle width, said at least one handle extending towards the periphery of said mounting plate on said top end and creating a lip thereon said top end, said at least one handle having an aperture for facilitating handling of said mounting plate, said aperture being oblong and centrally located thereon said at least one handle;

c. at least one hanging member disposed on said upper portion and said lower portion of said rear portion, said at least one hanging member having a length and a height wherein said height is greater than said length;

d. at least one of:

at least one storage box disposed on said front portion of said mounting plate; and at least one tool holder mounted perpendicularly to said mounting plate;

e. said at least one storage box having sidewalls and a bottom, said at least one storage box having an open top face for allowing said work-tools to be held within said sidewalls and on said bottom, each of said at least one storage box being parallel and coplanar to each other;

f. said at least one tool holder having at least one opening for receiving, securing and holding of said work-tools therethrough, said at least one tool holder being parallel and coplanar to each of said at least one storage box;

g. a ladder having at least one rung, wherein said at least one hanging member is configured to be attachable and detachable to said at least one rung of said ladder; and h. at least one planar element for receiving at least one of the work-tools, wherein said at least one planar element includes at least one planar element opening along lateral edges thereof.

2. The storage device as claimed in claim 1, wherein said at least one hanging member is hook-shaped to receive said at least one rung.

3. The storage device as claimed in claim 1, wherein at least one said handle and said hanging member is integral with or attached to said mounting plate.

4. The storage device as claimed in claim 1, wherein said at least one opening for receiving the work-tools being adjacent to one another.

5. The storage device as claimed in claim 1, wherein said planar element is integral with said storage box and/or said tool holder.

6. The storage device as claimed in claim 1, wherein said storage box is integral with said tool holder.

7. The storage device as claimed in claim 1, wherein at least one of: said at least one storage box, said at least one tool holder and said at least one planar element is disposed on said mounting plate as an integral unit.

8. The storage device as claimed in claim 1, wherein at least one of said at least one storage box, said at least one tool holder and said at least one planar element is disposed on said mounting plate as separate units.

9. The storage device as claimed in claim 1, wherein said at least one planar element in mounted below said at least one storage box.

10. The storage device as claimed in claim 1, wherein said at least one planar element opening being oblong and perpendicular to said mounting plate, said at least one planar element opening being parallel to each other.

11. The storage device as claimed in claim 1, wherein said at least one tool holder includes an at least one first tool holder mounted adjacently to each of said at least one storage box, said at least one first tool holder having first tool holder openings that extend perpendicularly to said mounting plate.

12. The storage device as claimed in claim 11, wherein said at least one tool holder includes a second tool holder mounted perpendicularly to said mounting plate, said second tool holder includes said at least one opening being adjacent to one another, said second tool holder including a lateral edge opening being oblong and perpendicular to said mounting plate, said second tool holder including a front aperture recessed at a front side of said second tool holder, said front aperture being open at said front side an amount less than the diameter of said front aperture along a top and bottom side thereof.

13. The storage device as claimed in claim 1, wherein said mounting plate has squared corners and said at least one handle has rounded corners.

14. The storage device as claimed in claim 1, wherein said at least one hanging member has an attaching portion the extends upwardly and being flush against said rear portion of said mounting plate, said at least one hanging member having a hooking portion mounted thereto said attaching portion and being substantially C shaped, said hooking portion extends above, behind and below said at least one rung of said ladder, said top portion of said attaching portion which extends above said at least one rung being longer than said bottom portion of said attaching which extends below said at least one rung, said top portion and bottom portion being parallel to each other.

* * * * *